US006745759B2

(12) United States Patent
Bossler

(10) Patent No.: US 6,745,759 B2
(45) Date of Patent: Jun. 8, 2004

(54) KNOCK-DOWN DOME COVER FOR A PATIO HEATER

(75) Inventor: Martin C. Bossler, Spring Grove, IL (US)

(73) Assignee: CPD Associates, Inc., Winston-Salem, NC (US)

( * ) Notice: Subject to any disclaimer, the term of this patent is extended or adjusted under 35 U.S.C. 154(b) by 268 days.

(21) Appl. No.: 10/066,864

(22) Filed: Aug. 10, 2001

(65) Prior Publication Data

US 2003/0029438 A1 Feb. 13, 2003

(51) Int. Cl.[7] ..... F24C 3/04

(52) U.S. Cl. ..... 126/92 B; 126/92 AC; 126/92 R

(58) Field of Search ..... 126/92 B, 92 A, 126/92 R; 431/328; 362/182

(56) References Cited

U.S. PATENT DOCUMENTS

| | | | | |
|---|---|---|---|---|
| D42,178 | S | 2/1912 | Roy | |
| 2,051,213 | A * | 8/1936 | Hamilton | 126/92 B |
| 3,020,384 | A | 2/1962 | Murphy | |
| 3,251,356 | A | 5/1966 | Prince et al. | |
| 3,503,379 | A | 3/1970 | Kuhn et al. | |
| 3,563,206 | A * | 2/1971 | Hermann | 119/305 |
| 4,614,166 | A | 9/1986 | Maurice | |
| 4,719,874 | A | 1/1988 | Maurice | |
| D325,963 | S | 5/1992 | Anderson | |
| 5,533,892 | A | 7/1996 | Long | |
| 5,950,615 | A | 9/1999 | Anderson et al. | |
| 5,964,233 | A | 10/1999 | Clark et al. | |
| 5,979,432 | A | 11/1999 | Grove | |
| D429,324 | S | 8/2000 | Olson et al. | |
| 6,102,031 | A | 8/2000 | Waters | |
| D445,889 | S | 7/2001 | Resmo et al. | |
| D447,796 | S | 9/2001 | Resmo et al. | |
| D451,988 | S | 12/2001 | Ashton et al. | |
| 6,336,450 | B1 * | 1/2002 | Collet | 126/92 B |
| 6,422,232 | B1 | 7/2002 | Ashton et al. | |
| 6,499,480 | B2 | 12/2002 | Ashton et al. | |

FOREIGN PATENT DOCUMENTS

| | | |
|---|---|---|
| DE | 2023734 | 11/1970 |
| EP | 0 976 979 A1 | 2/2000 |
| JP | 09-303784 | 11/1997 |
| WO | WO 98/58211 | 12/1998 |

* cited by examiner

*Primary Examiner*—Alfred Basichas
(74) *Attorney, Agent, or Firm*—Greer, Burns & Crain, Ltd.

(57) ABSTRACT

The present invention provides a dome cover for a outdoor heater that is made up of a plurality of sides. Each side has at least three edges, a first edge is a finished edge, a second edge includes at least a first complementary fastener portion and a third edge includes at least a second complementary fastener portion. The first and second complementary fastener portions are configured and arranged to fit together to removably attach adjacent pairs of sides to form a generally pyramidal shape. At least two edges on each of the sides are elevated at an angle above the plane formed by the base to form the generally pyramidal shape. A cap is configured and arranged to hold the sides at the preferred angle. A locking plate is designed to cooperate with the cap to capture the sides between them.

20 Claims, 5 Drawing Sheets

Fig. 5
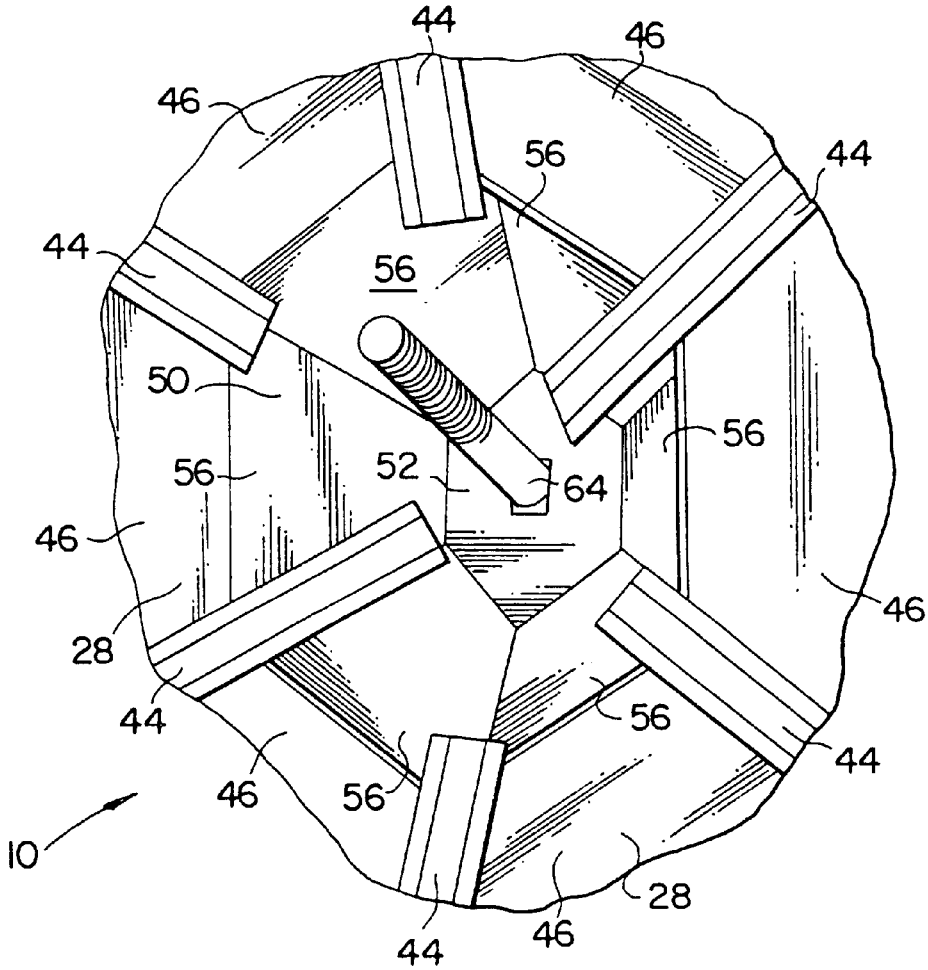
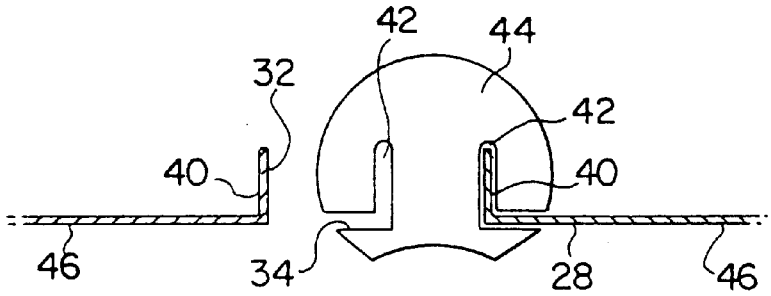
Fig. 7

KNOCK-DOWN DOME COVER FOR A PATIO HEATER

BACKGROUND

Outdoor or patio heaters have become popular for providing warmth in the out of doors, for example on a cool summer evening or in the spring or fall. Heat is provided by a burner atop a standard that burns a fuel, such as propane. Flames from the burner heat an insulator that becomes red hot and gives off radiant heat in all directions through an emitter, providing the desired warmth. A dome cover generally covers the burner and emitter from some of the weather, such as rain, but it also retains hot gasses rising from the burner, and reflects radiant heat that is directed skyward back down toward the users.

As the insulator is heated, it becomes red hot and emits radiant heat in all directions. However, on a windy day, if the breeze reaches the burner, it can change the heat distribution around the insulator. Heat will be carried by the breeze from the side facing the wind to the side away from the wind, significantly reducing the warmth on the windward side of the heater. Such changes in temperature distribution are visually indicated by the color of the insulator. When there is no wind, it is a uniform bright red color. However, introduction of a steady breeze of approximately 10 miles per hour results in a lack of coloration on approximately one quarter of the insulator facing the wind and a noticeable drop in temperature on that side.

The size of the dome cover is carefully considered to trade off the amount of surface area available to reflect heat and protect the burner from weather compared with the shipping cost of the unit. The dome cover is generally supplied as a one-piece item. As the size of the dome cover increases to block more wind and reflect additional heat, a larger shipping box is required to contain it. As the box for each heater gets larger, fewer numbers of units are able to fit inside a shipping container, thus increasing shipping costs. Currently, some manufacturers ship the dome cover separately from the heating unit to minimize the overall shipping volume and reduce costs.

It is therefore an object of this invention to provide an improved dome cover for a outdoor heater that improves heat distribution under windy conditions.

It is another object of this invention to provide an improved dome cover with a larger surface area to better reflect radiant heat that does not result in higher shipping costs.

It is yet another object of this invention to provide an improved dome cover for an outdoor heater that is readily assembled by the user without the need for tools.

SUMMARY OF THE INVENTION

These and other objects are met or exceeded by the present dome cover for a patio heater that provides improved wind protection without high shipping costs. The dome cover present ships compactly in a number of pieces and is easily assembled without the need for tools.

More specifically, the present invention provides a dome cover for an outdoor heater that is made up of a plurality of sides. Each side has at least three edges, a first edge is a finished edge, a second edge includes at least one first complementary fastener portion and the third edge includes at least a second complementary fastener portion. The first and second complementary fastener portions are configured and arranged to fit together to removably attach adjacent pairs of said sides to form a generally pyramidal shape. At least two edges on each of the sides are elevated at an angle above the plane formed by the base to form the generally pyramidal shape.

A cap is configured and arranged to hold the sides at the angle, and a locking plate is configured and arranged to cooperate with the cap to capture the sides between them.

During assembly, the tongue and groove of adjacent sides are attached to each other until all sides are attached to form a pyramid. The cap is placed on the top of the pyramid where all of the sides converge. All of the sides are held in place by placing the locking plate in such a position that each of the sides is sandwiched between the locking plate and the cap. An optional fastener holds the sandwich together. This construction makes the dome cover easily assembled by the user without the need for tools.

The knock down construction of the present dome cover allows it to be made larger for improved heat distribution on a windy day. Making the pyramid taller by increasing the angle of the sides with respect to the base of the pyramid blocks more wind from interfering with an even heat distribution out of the burner by blocking the wind for a greater depth. Enlarging the dome cover also provides a larger zone of calm air so that the area around the burner is less susceptible to eddys or wind currents that may penetrate the edge of the dome cover. A larger surface area around the burner also reflects more of the radiant energy downward toward the users.

Despite the larger size, the present dome cover is no more costly, and may be less costly, to ship than prior art dome covers. Shipment of the dome cover in several pieces greatly reduces the amount of space required to accommodate the larger size. Yet, due to the handy knock down construction, assembly of the dome cover is accomplished without tools or inconvenience to the user. The present dome cover also allows for the unit to be easily packed away for winter storage, taking up a minimum amount of space.

BRIEF DESCRIPTION OF THE DRAWINGS

FIG. 5 is a close-up view of the bottom of the dome cover, before installation of the locking plate;

FIG. 7 is a cross section of two panels aligned with but not inserted into a rib.

DETAILED DESCRIPTION OF THE INVENTION

Figure 1:
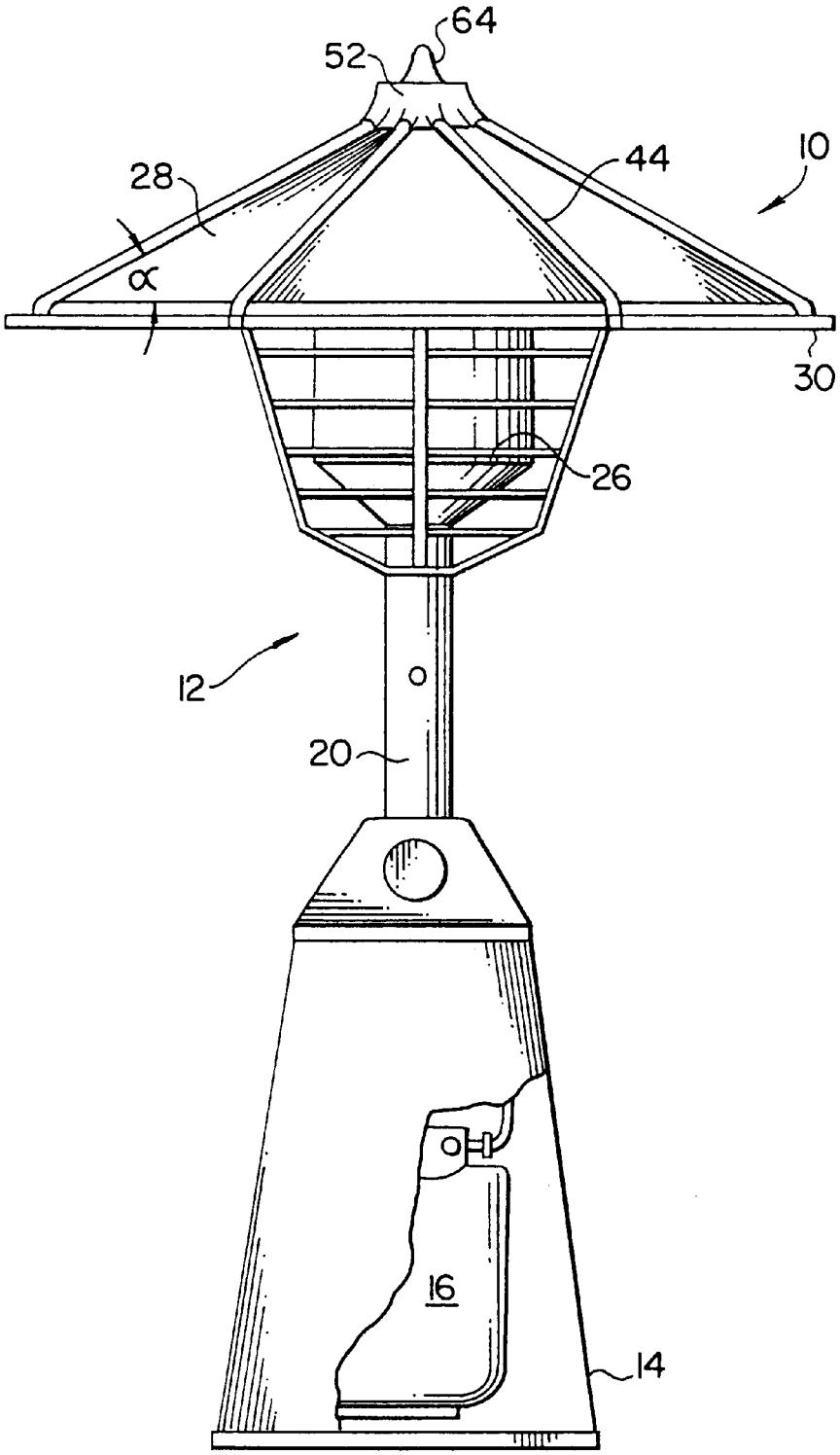
FIG. 1 is a perspective view of a outdoor heater with the present dome cover with a portion of the base cut away.
Figure 2:
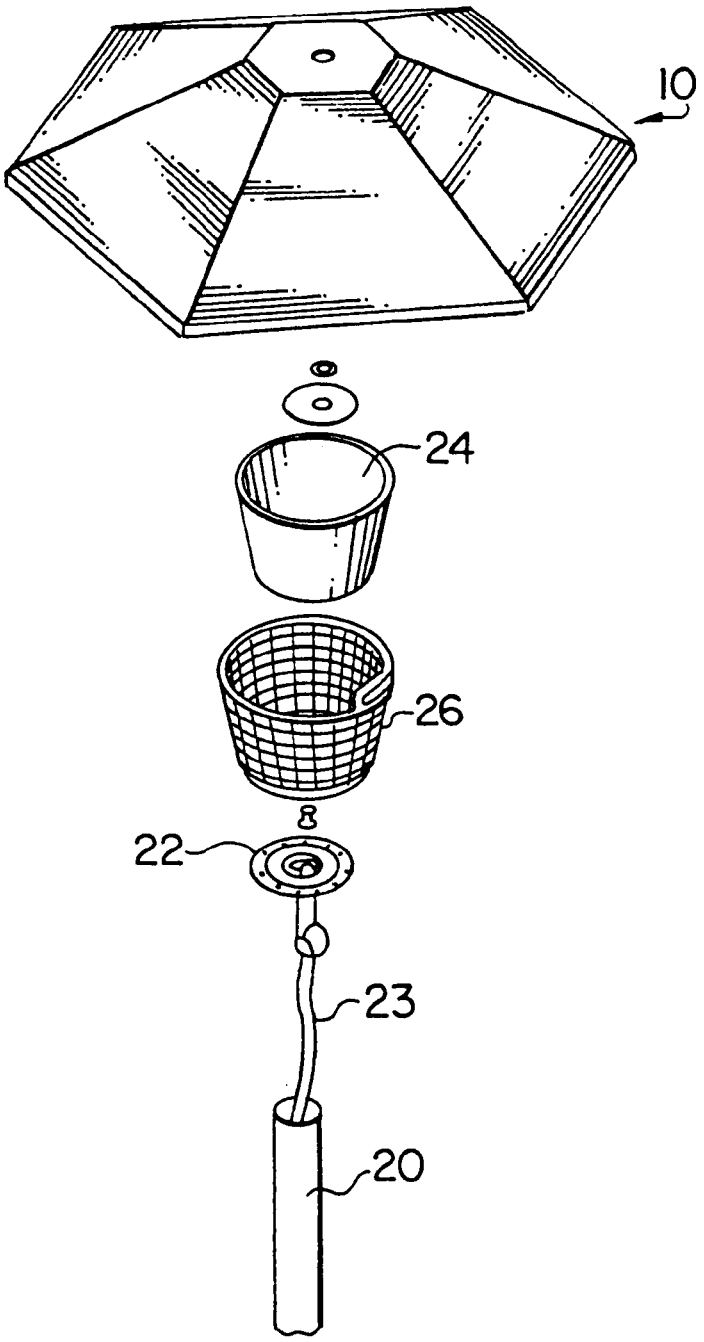
FIG. 2 is an exploded view of the top of the heater, showing the burner and insulator behind the emitter.

Referring now to FIGS. 1 and 2, the dome cover, generally designated 10, is designed for an outdoor heater, generally 12. The present dome cover is equally useful on any size or type of outdoor or patio heater. A base 14 that provides weight and stability to the heater 12 is constructed so that it is not easily tipped over when in use. Fuel from a fuel source 16, such as an LP gas tank, is piped up the inside of a standard 20 to a burner 22 through fuel line 23. Burning of the fuel heats an insulator 24 causing it to become red hot and emit copious amounts of radiant heat. A perforated metal emitter 26 protects the burner 22 while allowing the combustion gasses to escape to the atmosphere.

The present dome cover is constructed in pieces that are assembled by the consumer. Preferably, the cover 10 is made of a knock down construction that is easily assembled by the user without the need for tools. Parts removably attach to each other preferably using a tongue and groove, tab and slot, friction fit elements or other types of knock down construction known in the art. Throughout this specification and claims, references to direction, up and down, for example, refer to the outdoor heater and dome cover as oriented as in FIG. 1.

Any lightweight, flexible material is suitable for construction of the dome cover 10. Since the dome cover 10 is supported in the middle, the material from which it is construction should be strong enough to hold its shape. During use, the cover 10 is subjected to heat radiated from the insulator 24 and hot air rising from the burner. To be useful, the dome cover 10 should not sag or lose its shape under these conditions. Metals and high temperature plastics are the preferred construction materials. High temperature polymer resins, such as polyimides, are suitable. Because of the low cost, malleability, and ready availability, metals, including aluminum, are most preferred.

Figure 6:
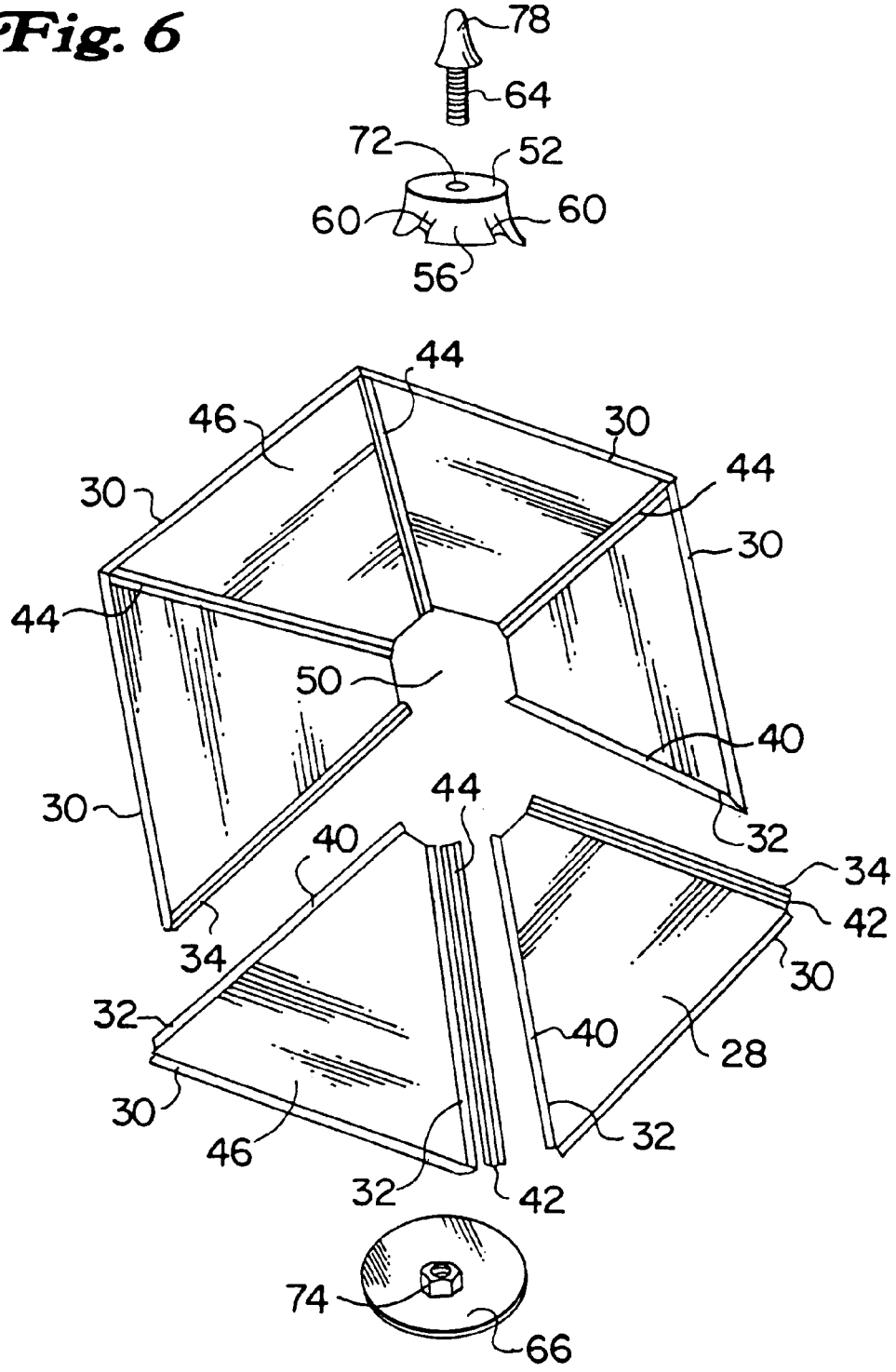
FIG. 6 is an exploded view of the dome cover of FIG. 3.

The dome cover 10 is made up of a plurality of sides 28 each having at least first, second and third edges 30, 32, 34, seen best in FIGS. 6 and 7. These edges may be defined functionally as well as literally. For example, where the corners of the sides 28 are rounded, forming one continuous edge, the first edge 30, the second edge 32 and the third edge 34 are suitably considered to be portions of one or more larger edges.

The first edge 30 is a finished edge. This is the edge that will be exposed to users while the heater 12 is in operation. The finished edge 30 is merely one that has no sharp, burred or jagged edges that would tend to injure a person who touched the edge. Preferably, the finished edge 30 is a smooth edge, a rolled edge, a coated edge, a folded edge, a sanded edge, or an edge treated by any other means to remove burrs or sharp portions. Most preferably, the finished edge also has a lip 36 extending downwardly.

The second edge 32 has at least a first complementary fastener portion 40 that removably attaches to a second complementary fastener portion 42 on the third edge 34 of the adjoining side 28. Preferably, the first complementary fastener portion is a tongue 40, tab, hook or other protrusion that is removably received into the second complementary fastener portion, such as a groove 42, slot, opening or indentation. As the tongue 40 and groove 42 construction is the preferred method of removably attaching the sides 28 to each other, it will be exemplified in the following discussion. However, other ways of attaching the sides 28 are contemplated, and in some circumstances may be preferred.

The tongue 40 and the groove 42 are configured and arranged for removably attaching each adjacent sides 28 to each other. Although both the tongue 40 and groove 42 are preferably integral parts of the side 28, it is also contemplated that the side 28 includes two or more parts, such as a rib 44 and a panel 46. Optionally, either the tongue 40 or the groove 42 is part of the rib 44 that is removably attachable to either the second edge 32 or the third edge 34 of the panel 46. For some users, it may be easier to assemble the dome cover 10 if, for example, all tongues 40 are located on the panel 46 and all grooves 42 are located on the rib 44. The ribs 44 optionally add structural strength to the dome cover 10.

In the preferred embodiment, each of the ribs 44 provides at least two grooves 42, while each of the panels 46 has at least two tongues 40. Attaching one of the tongues 40 into one of the grooves 42, removably attaches the rib 44 to the panel 46. The resulting side 28 has the required tongue 40 on the second edge 32 and groove 42 on the third edge 34.

Preferably the sides 28 are generally flat or of a configuration that they nest together to conserve space during shipping. "Generally flat" means that the thickness of the single side, including the finished edge 30 and the optional ribs 44, is less than 25% of the smaller of the first edge 30, the second edge 32 or the third edge 34. Most preferably, each of the sides 28 is identical to every other side and designed so that each of the sides nest inside each other to minimize space required for storage or shipping.

Figure 3:
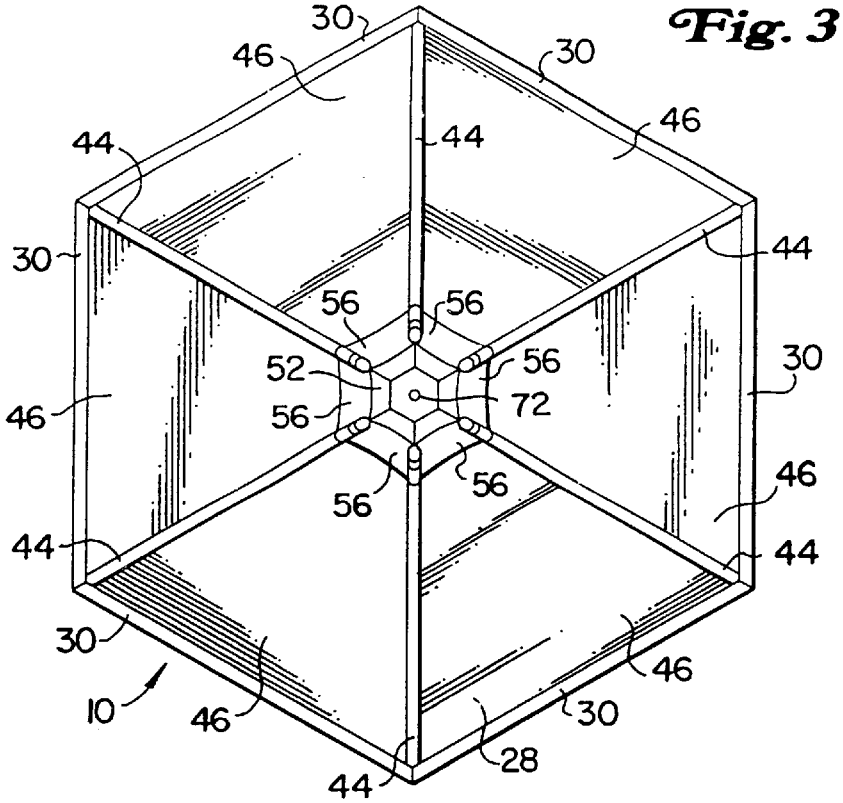
FIG. 3 is a top view of the present dome cover.
Figure 4:
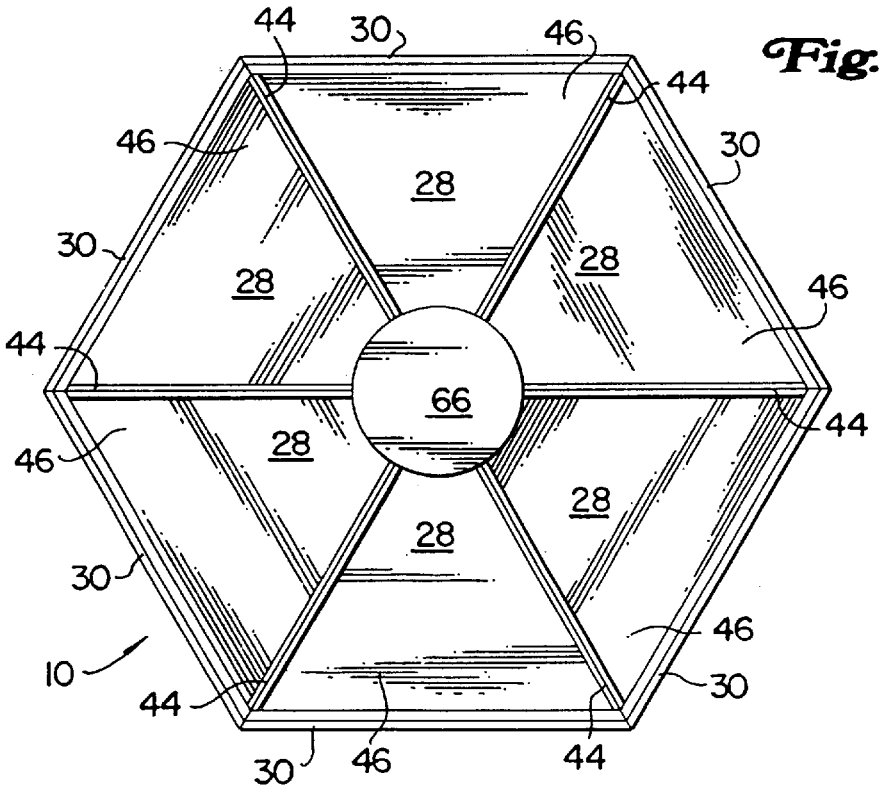
FIG. 4 is a bottom view thereof.

Referring now to FIGS. 3 and 4, when all sides 28 are removably attached to each other, a generally pyramid or umbrella shaped dome is formed. Any number of sides may be used, but use of from four to about ten sides is preferred. The preferred shape for the side 28 is generally a three or four sided polygon, and in some cases a trapezoid is formed. Although triangular sides are generally used to make a pyramid, in this case it is advantageous to remove a portion of one or more sides 28 to make room for hardware to hold all of the sides 28 together. Use of trapezoidal sides 28 defines an opening 50 in the center of the dome cover 10 when the panels are all attached, however, use of a shape having no parallel sides is also contemplated. Each of the sides 28 are preferably elevated at an angle, $\alpha$, (FIG. 1) above the plane formed by the base of the pyramid, allowing the finished edges 30 of the dome cover 10 to hang lower than the top of the emitter 26 to which it is attached. The preferred angle, $\alpha$, is preferably between about 10° and about 20° relative to the pyramid base.

As shown in FIG. 6, at the apex of the pyramid, there is a cap 52 that is configured and arranged to hold the sides 28 at the desired angle. The preferred cap is shaped somewhat like a bowl with flattened walls 56, having one wall for each side 28. Indentations 60 or other shapes are optionally included on the inside of the cap 52 to matingly engage the ribs 44, preventing the cap from turning when a fastener 64 is applied.

A locking plate 66 is configured and arranged to frictionally engage each of the sides 28 with the cap 52. Many shapes are suitable for the locking plate 66, as long as it sandwiches each of the sides 28 between the locking plate 66 and the cap 52 when the fastener 64 is applied, holding all parts of the dome cover 10 together. The preferred locking plate 66 is a circle or a polygon with the same number of faces as there are sides 28. Suitably, the locking plate 66 is optionally a bowl shape to matingly engage with the cap 52, however use of a flat surface for the plate is sufficient and is preferred for its simplicity, ease of manufacture and low cost.

The fastener 64 holds the locking plate in position to frictionally engage each of the sides 28 with the cap 52. In keeping with the objective requiring no tools for assembly, preferably the fastener 64 is one that is easily installed and tightened by hand, such as a bolt or other threaded fastener 64. If a bolt 64 is used, the cap 52 has an opening 72 to receive the bolt. The preferred opening 72 is itself threaded or has a nut 74 affixed thereto to securely hold the bolt 64. Any fastener 64 optionally includes a decorative portion 78 above the cap 52 to make it aesthetically pleasing.

The dome cover is preferably assembled by first placing one of the ribs 44 on each of the panels 46, if ribs are provided, forming the sides 28. Each of the sides 28 is then properly aligned and removably attached to each other, for example by engaging tongue 40 in the second edge 32 of the side 28 into groove 42 in the third edge 34 of the adjacent side. The finished edges 30 are all adjacent to each other forming the outline of the base of a pyramid formed by the sides 28. After all sides 28 have been joined to each other, the cap 52 is placed on the top of the pyramid, aligning the indentations 60 with the ribs 44, if present. The locking plate 66 is positioned on the inside of the pyramid and aligned with the cap 52 so that the sides 28 are sandwiched between the locking plate and the cap. The entire assembly is held together by friction when the fastener 64 is attached through the opening 72, holding the locking plate 66, the sides 28 and the cap 52 in position.

While a particular embodiment of the present invention has been shown and described, it will be appreciated by those skilled in the art that changes and modifications may be made thereto without departing from the invention in its broader aspects and as set forth in the following claims.

What is claimed is:

1. A dome cover for a outdoor heater comprising:

a plurality of sides each having at least three edges, a first edge is a finished edge, a second edge comprises at least a first complementary fastener portion and a third edge comprises a second complementary fastener portion, said first and said second complementary portions being configured and arranged for removably attaching adjacent pairs of said sides to form a generally pyramidal shape, said sides of which elevated at an angle above the plane formed by the base of said generally pyramidal shape;

a cap configured and arranged to hold said sides at said angle; and a locking plate configured and arranged to cooperate with said cap to capture said sides therebetween.

2. The dome cover of claim 1 wherein said generally pyramidal shape is a regular pyramid having from 4 to 10 trapezoidal sides.

3. The dome cover of claim 1 wherein said first complementary fastener portion is a tongue and said second complementary fastener portion is a groove.

4. The dome cover of claim 3 wherein said cap cooperates with said locking plate to capture said sides therebetween by use of a fastener.

5. The dome cover of claim 3 wherein said cover comprises a lightweight, flexible material.

6. The dome cover of claim 5 wherein said material comprises aluminum.

7. The dome cover of claim 1 wherein said sides are substantially flat.

8. The dome cover of claim 1 wherein said sides are triangular or trapezoidal in shape.

9. The dome cover of claim 1 wherein said side further comprises a rib attached to a panel.

10. The dome cover of claim 9 wherein said rib is removably attached to said panel.

11. The dome cover of claim 9 wherein said cap comprises indentations arranged to receive said ribs.

12. The dome cover of claim 1 wherein said fastener is a decorative bolt.

13. The dome cover of claim 12 wherein said locking plate comprises a nut.

14. The dome cover of claim 1 wherein said locking plate is one of a circle and a regular polygon having the same number of faces as the number of said sides.

15. The dome cover of claim 1 wherein said cover is of knock-down construction allowing assembly without the use of tools.

16. A outdoor heater comprising:

a base;

fuel from a fuel source;

a burner;

an insulator;

an emitter to expel combustion gases from burning of said fuel; and a dome cover having a plurality of sides each having at least three edges, a first edge is a finished edge, a second edge comprises at least one tongue and a third edge comprises a groove, said tongue and said groove being configured and arranged for removably attaching each of said sides to adjacent of said sides to form a generally pyramidal shape, said sides of which elevated at an angle above the plane formed by the base of said generally pyramidal shape;

a cap configured and arranged to hold said sides at said angle;

a locking plate configured and arranged to frictionally engage each of said sides with said cap; and a fastener to hold said locking plate in position to frictionally engage each of said sides with said cap.

17. The outdoor heater of claim 16 wherein said dome cover further comprising a rib attached said second edge or said third edge of each of said sides, said rib comprising a tongue if said rib is attached to said second edge or said rib comprising a groove if said rib is attached to said third edge.

18. The outdoor of claim 17 wherein said rib is removably attached to said side.

19. The outdoor heater of claim 16 wherein said generally pyramidal shape of said dome cover is a regular pyramid having from 4 to 10 trapezoidal sides.

20. The outdoor heater of claim 16 wherein said dome cover is of knock-down construction allowing assembly without the use of tools.

* * * * *